US006935442B2

(12) United States Patent
Boulet et al.

(10) Patent No.: US 6,935,442 B2
(45) Date of Patent: Aug. 30, 2005

(54) STABILIZER DEVICE FOR ROTARY STRING OF DRILL RODS WITH REDUCED FRICTION

(75) Inventors: Jean Gilbert Boulet, Paris (FR); Christophe Reullon, Cosne sur Loire (FR)

(73) Assignee: S.M.F. International, Sur Loire (FR)

( * ) Notice: Subject to any disclaimer, the term of this patent is extended or adjusted under 35 U.S.C. 154(b) by 25 days.

(21) Appl. No.: 10/635,639

(22) Filed: Aug. 7, 2003

(65) Prior Publication Data

US 2004/0026131 A1 Feb. 12, 2004

(30) Foreign Application Priority Data

Aug. 8, 2002 (FR) ..... 02 10114

(51) Int. Cl.[7] ..... E21B 17/10
(52) U.S. Cl. ..... 175/325.3; 175/323
(58) Field of Search ..... 175/325.3, 76, 175/323, 325.1, 325.2; 166/241.1

(56) References Cited

U.S. PATENT DOCUMENTS 1,824,466 A * 9/1931 Criley ..... 175/325.3
2,072,320 A 3/1937 Thomas
2,715,552 A 8/1955 Lane
3,370,657 A * 2/1968 Wade ..... 175/74
4,984,633 A * 1/1991 Langer et al. ..... 166/241.1
4,989,679 A * 2/1991 Amaudric du Chaffaut ..... 175/325.3
5,931,239 A * 8/1999 Schuh ..... 175/61
6,250,405 B1 6/2001 Moore et al.
6,702,042 B2 * 3/2004 Genevois et al. ..... 175/45

FOREIGN PATENT DOCUMENTS

FR 2 625 253 A1 6/1989

* cited by examiner

*Primary Examiner*—David Bagnell
*Assistant Examiner*—K. Thompson
(74) *Attorney, Agent, or Firm*—Sughrue Mion, PLLC

(57) ABSTRACT

The stabilizer (1) has a tubular central body (3) having means for connection (3*a*, 3*b*) to a first and a second component of the string of drill rods and at least one external contact element (4) with a wall (2*a*) of the borehole (2). The external element (4) for contact of the stabilizer (1) with the wall (2*a*) of the borehole (2) has at least one means for activation (6) of a means (7) co-operating with the wall (2*a*) of the borehole (2) to limit the friction between the contact element (4) and the wall (2*a*) of the borehole (2). The activation means can consist of inter-blade spaces (6) for acceleration of the circulation (7) of the drilling liquid or by a means for coupling in rotation of the external element (4) and the central body (3) of the stabilizer (1).

19 Claims, 4 Drawing Sheets

STABILIZER DEVICE FOR ROTARY STRING OF DRILL RODS WITH REDUCED FRICTION

FIELD OF THE INVENTION

The invention relates to a stabiliser device for a rotary string of drill rods with reduced friction.

BACKGROUND OF THE INVENTION

In order to carry out drilling, and in particular drilling for oil, strings of drill rods are used which consist of drill rods assembled end to end in the course of drilling, which is effected with the aid of a drilling tool fixed at the end of the drill string and set in rotation around its longitudinal axis and subjected to a force in the axial direction due in particular to the weight of the drill string.

So as to ensure centring and guiding of the drill string in the interior of the borehole, it is known to use centring devices called stabilisers which have a central body of tubular shape and an external part having in particular at least one contact element by means of which the stabiliser comes into contact with the wall of the borehole in order to ensure the centring and guiding of the drill string.

The central body of the stabiliser has at its axial ends screw threads for connection to components forming the string of drill rods and generally to two drill rods between which the stabiliser is interposed as the string of drill rods is being assembled.

The external contact element of the stabiliser may be formed for example by blades in the axial direction or disposed helically around the external surface of the stabiliser.

Such stabilisers can ensure effective centring and guiding of the drill string in the interior of the borehole, but this is achieved by accepting permanent friction of the external contact element of the stabiliser on the wall of the borehole.

This friction increases the forces brought into play along the drill string during drilling and, in certain cases, may become excessive or lead to complete jamming of the drill string.

In the case of drilling in soft formations, the increase in the friction due to the presence of stabilisers may be reflected in a widening of the borehole, in particular in the diverted parts of the drilling where in the inclination relative to the vertical direction may be substantial.

The friction at the level of the stabiliser includes an axial component due to the displacement of the drill string in the axial direction of the drill string and a radial or circumferential component due to the rotation of the drill string in the interior of the borehole.

In order to carry out drilling in satisfactory conditions, it is necessary to limit or to manage as far as possible the coefficients of friction in rotation ($\mu_r$) and in axial displacement ($\mu_a$). Management of the coefficients $\mu_r$ and $\mu_a$ makes it possible to control the mechanical interactions between the elements of the string of drill rods and the wall of the borehole, in particular at the level of the stabilisers. This management makes it possible to optimise the centring and guiding of the drill string.

Stabilisers are known in which the external contact element of the stabiliser, which is formed for example by blades attached to or machined on the external part of the stabiliser or by a casing, is produced in such a way as to be rigidly joined to the central body or even integral with the tubular central body of the stabiliser.

In this case the contact element of the stabiliser which is rigidly jointed to the drill string is constantly in rotation during the drilling and in frictional contact with the wall of the borehole. The friction of the stabiliser in rotation in the borehole is reflected by a high radial friction $\mu_r$.

Stabilisers are also known in which the external contact element of the stabiliser, produced for example in the form of a casing on which stabiliser blades or attached or machined, is mounted so as to rotate about the axis of the stabiliser and to slide in the axial direction on the tubular body or central shaft with a freedom of movement in the axial direction between two extremes in which the external contact element of the stabiliser comes into engagement with a means for coupling to the central shaft. Such a coupling means may consist for example of the teeth of a dog clutch system.

The external contact element of the stabiliser is retained in an intermediate position between its two end positions by resilient restoring means such as springs interposed between the external contact element of the stabiliser and the central shaft or body, at each end thereof.

Consequently, when the axial forces exerted on the contact element during drilling do not exceed a certain limit defined by the force of the springs, the contact element is free to rotate relative to the tubular central shaft or body. The tubular central shaft or body, which is joined to the drill string, can then turn in the interior of the external contact element of the stabiliser which is in contact with the wall of the borehole and which then only moves in axial translation.

In this type of operation of the stabiliser, the contact element of the stabiliser is immobilised in rotation against the wall of the borehole and the radial friction of the stabiliser in rotation, which is limited to the internal friction of a bearing for rotary mounting of the contact element on the tubular shaft, is very low.

When the axial forces exerted on the external contact element of the stabiliser exceed the limit fixed by the resilient restoring means, the contact element moves relative to the central shaft until a part of the end of the external contact element having a dog clutch toothing meshes with a corresponding toothing on the tubular central shaft of the stabiliser. The contact element of the stabiliser is then coupled in rotation to the tubular shaft and to the drill string, so that it is set in rotation on contact with the wall of the borehole.

The friction in rotation then increases considerably.

Such engagement of the contact element of the stabiliser in the rotation position with the drill string is produced in particular when the stabiliser encounters a narrowed or more or less closed zone of the borehole, either during drilling or during lifting of the tool. The axial forces applied to the contact element then increase and may exceed the limit of forces determined for the displacement of the contact element against the restoring springs. The setting in rotation of the stabiliser can ensure the boring or the re-boring of the borehole in order to permit the passage of the stabiliser and of the drill string, in particular when the stabiliser has blades having cutting edges.

When the axial force on the external contact element of the stabiliser returns to a level lower than the restoring force of the springs, the external contact element of the stabiliser returns to its intermediate position in which it is no longer driven in rotation by the central shaft and the drill string and is immobilised in rotation against the wall of the borehole. The friction in rotation of the stabiliser returns to a low level.

The axial friction during operation of the stabilisers, irrespective of whether they are of the first type, that is to say produced in one piece, or of the second type, that is to say with a contact element mounted so as to slide and rotate on the central shaft, remains very high.

Furthermore, in the case of stabilisers in which the contact element is mounted so as to rotate on the central shaft and is retained in a position which ensures the relative of rotation of the shaft with respect to an external contact element which remains immobile against the wall of the borehole, the elements for retaining the external contact element generally consist of springs interposed between the ends of the contact element and bearing surfaces of the central shaft. In this case, when the contact element is displaced in one direction, one of the restoring springs is compressed and the other spring is relaxed, such that the force applied by one of the springs increases while the force applied by the other spring decreases, so that perfect management of the control of the displacement of the contact element of the stabiliser is difficult.

When the contact element of the stabiliser is engaged in a coupling position with the central shaft by one of its end parts, the stability of this position is not ensured because the restoring forces are not exerted in an identical manner on the two ends of the external contact element.

U.S. Pat. No. 4,989,679 proposes, so as to improve the conditions for coupling of the external contact element of the stabiliser to the central body of the stabiliser in order to set it in rotation, to use a friction clutch which makes it possible to set the contact element in rotation progressively.

Such a device can only function correctly for moderate axial actuating forces. In particular, such stabilisers with a friction clutch cannot be used as stabilisers having a very wide operating range in so far as the axial forces are concerned.

Furthermore, the mounting of the contact element of the stabiliser between two restoring springs in the devices according to the prior art also limits the extent of the operating range in the non-rotary mode or also the threshold values of the axial forces of engagement of the means for driving the contact element in rotation.

This results in particular in risks of untimely engagement of the coupling means of the contact element for relatively low force values and an instability of operation of the stabiliser in non-rotary mode.

Therefore a stabiliser has not hitherto been known which makes it possible to ensure good management of the friction and in particular the axial friction during drilling in such a way as to limit this axial friction to a level permitting the drilling to be carried out in a continuous manner in good conditions.

In the case of stabilisers in one piece which are fixed in rotation to the drill string, the axial friction of the stabilisers is generally high and could not be modified by structural characteristics of these stabilisers in one piece.

In the case of stabilisers having a contact element mounted so as to be movable on a central shaft in order to pass from a non-rotary mode of operation to a rotary mode of operation, the management of the axial friction obtained by setting the contact element in rotation when the axial forces become excessive is not perfectly ensured due to the lack of reliability of the control of engagement of the contact element in order to set it in rotation.

Furthermore, such devices for management of the axial friction cannot be used for very high levels of force.

Finally, perfect stability of the contact element in the non-rotary mode of operation cannot be obtained within a wide range of axial forces in the interior of the borehole.

BRIEF SUMMARY OF THE INVENTION

The aim of the invention, therefore, is to propose a stabiliser device for a string of drill rods which can rotate about a longitudinal axis of the drill string and is subjected to a force in the axial direction ensuring the centring and guiding of the drill string in a borehole and has a tubular central body having means for connection to a first and a second component of the string of drill rods at a first and a second axial end and at least one external element for contact of the stabiliser with a wall of the borehole, wherein this device makes it possible to reduce the friction in operation of the stabiliser on the wall of the borehole, in a temporary or permanent manner, whilst still being capable of operating in a stable manner within a wide range of axial forces exerted on the contact element during drilling.

In order to achieve this object, the external element for contact of the stabiliser with the wall of the borehole has at least one means for activating a means which co-operates with the wall of the borehole in order to limit the friction between the external contact element of the stabiliser and the wall of the borehole, and this external contact element is mounted on the central body of the stabiliser in an axial position which remains fixed at least within a range of values of an axial force exerted between the central shaft and the external contact element, the extent of which can be fixed at any value whatsoever.

According to a first embodiment, the means which co-operates with the wall of the borehole in order to limit the friction consists of a drilling liquid such as a drilling mud circulating in an annular space between the wall of the borehole and the external surface of the drill string and the means for activation of the drilling liquid is formed by the external surface of the contact element of the stabiliser having blades and inter-blade spaces which create an effect of a liquid bearing around the stabiliser.

In the case of the first embodiment, the stabiliser can be produced in one piece which constitutes both the tubular body of the stabiliser, by its internal part, and the element for contact with the wall of the borehole, by its external part.

The stabiliser can also have a tubular body on which is mounted an external contact element such as a sleeve mounted so as to rotate about the axis of the stabiliser and to slide in the axial direction so as to move between a first position in which the external contact element is rotatable relative to the central body and fixed in rotation during the drilling and at least one position in which the external contact element is fixed in rotation with the central body of the stabiliser which is itself joined to the string of drill rods, the external element then being rotatable during drilling.

In the case where the stabiliser has an external contact element mounted so as to rotate and to slide on the central body of the stabiliser, the axial retention of the contact element mounted so as to be movable in translation and in rotation on the central body of the stabiliser is ensured by two axially extending restoring devices such as restoring springs which are in contact at their axial ends at the same time with two radial edges of the central shaft and of the contact element which are compressed and exert on a first axial end and on a second axial end of the contact element opposing forces which make it possible to obtain a very great stability of position of the contact element in a configuration ensuring its rotatable mounting on the drill rod and its immobilisation in rotation in the borehole. In the case where the axial forces exerted between the contact element and the central body of the stabiliser joined to the string of drill rods go above a fixed limit, for example in the case of an obstruction or a narrowing of the borehole, the contact element of the stabiliser moves axially to a position of coupling with the central body of the stabiliser and the string of drill rods in order to be set in rotation. This setting in rotation of the contact element makes it possible to effect boring of the borehole, particularly in the case where the contact element of the stabiliser has blades having cutting edges. The re-boring of the borehole makes it possible to reduce the friction of the stabiliser on the walls of the borehole and to continue the progression of the string of drill rods.

BRIEF SUMMARY OF THE DRAWINGS

In order to aid understanding of the invention, a description will now be given by way of example, with reference to the accompanying drawings, of several embodiments of stabilisers according to the invention with reduced friction.

DETAILED DESCRIPTION OF PREFERRED EMBODIMENTS

Figure 1:
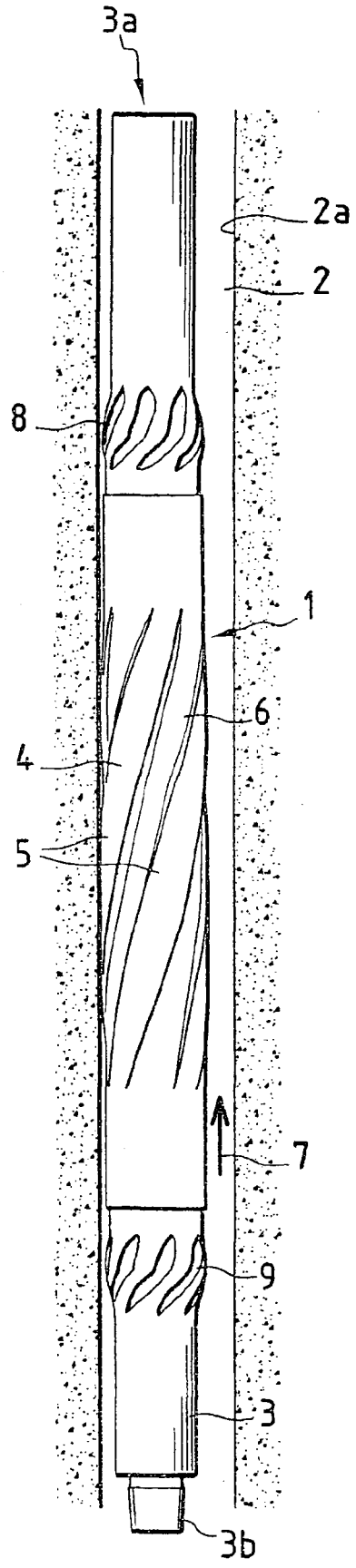
FIG. 1 is a lateral view in elevation of a stabiliser having a movable casing and having hydraulic profiles which is produced according to the invention.

FIG. 1 shows a stabiliser according to the invention, designated overall by the reference numeral 1, in the operating position in the interior of a borehole 2 produced by a tool of a string of drill rods on which the stabiliser 1 is interposed which is intended to ensure the centring and the guiding of the drill string in the borehole before the drilling advances.

The stabiliser 1 has a central body 3 on which is mounted a tubular element 4 which constitutes the external casing for contact of the stabiliser with the wall 2*a* of the borehole 2.

The body 3 of the stabiliser has at a first axial end 3*a*, or upper end, and at a second axial end 3*b*, or lower end, respectively a female screw connection element and a male screw connection element.

The threaded connecting parts 3*a* and 3*b* of the stabiliser which are produced in the form of a tapped part and a threaded part in the shape of a truncated cone are conventional elements in the case of drilling equipment and permit the connection of the stabiliser (which is shown in FIG. 1 in its operating position) to a component of the drill string situated above the stabiliser and to a component of the drill string situated below the stabiliser, according to the axial direction of the drill string in the interior of the borehole 2.

Generally the stabiliser is interposed between two rods of the drill string and has a maximum external diameter substantially greater than the nominal diameter of the drill rods. For this reason the stabiliser 1 which comes into contact with the wall 2*a* of the borehole 2 by way of its external casing 4 ensures centring and guiding of the drill rod in the interior of the borehole 2.

The external contact casing 4 of the stabiliser which is mounted so as to slide in the axial direction and to rotate about the axis of the stabiliser on the central body 3 has on its external surface blades 5 by means of which the stabiliser comes into contact with the wall 2*a* of the borehole 2. Between two successive blades the external casing 4 has an inter-blade space 6 which is machined and profiled in such a way as to limit the circumferential and axial friction of the stabiliser in the interior of the borehole.

The casing 4 having the blades 5 and the inter-blade spaces 6 as shown could also be mounted so as to rotate on the central body 3 about the axis of the stabiliser and immobilised in axial translation between two shoulders of the central body.

A drilling liquid such as a drilling mud circulates in the vertical direction and from top to bottom in the interior of the drill string and in particular in the interior of the central body 3 of the stabiliser 1 produced in tubular form, in order to reach the drilling tool at a lower end of the string of drill rods.

The drilling liquid which flushes the base of the hole and transports the drilling debris to the surface circulates in the vertical direction and from bottom to top in an annular space delimited between the external surface of the string of drill rods and the wall 2*a* of the borehole, as shown by the vertical arrow 7 directed upwards in FIG. 1.

The circulation of the liquid in contact with the external surface of the stabiliser makes it possible to obtain an effect of a liquid bearing around the stabiliser, particularly due to the cooperation of the profiles of the inter-blade spaces 6 with the longitudinal profile of the external surface of the casing.

Furthermore, when the friction between the external casing of the stabiliser and the wall 2*a* of the borehole increases above a predetermined limit, for example in the case of a narrowing of the borehole or the presence of blocking elements in the borehole, the external casing 4 is displaced axially with respect to the central body to a position of coupling in rotation with the body 3 joined to the string of drill rods in rotation. The casing 4 is then set in rotation joined to the string of drill rods and ensures, by way of the blades 5, a re-boring of the borehole which ensures a reduction in the friction and in particular the axial friction and a passage of the stabiliser through the narrowing or the degraded part of the borehole.

This effect can be achieved just as well when the drill string is being lowered during drilling as when the drill string is being lifted at the end of drilling.

As can be seen in FIG. 1, the body 3 of the stabiliser also has on one side or on either side of the external casing 4 one or two parts 8, 9 which constitute bulges of the body 3 rotationally around the axis 11 of the stabiliser and in particular with a substantially spherical shape on which helical grooves are machined. These two parts which are widened diametrically relative to the nominal diameter of the rods of the drill string and of the central body 3 of the stabiliser make it possible to carry out pre-boring of the bole, before the passage of the casing 4 of the stabiliser, either during lowering or during lifting.

In the case of a stabiliser of which the external casing is mounted so as to rotate on the central body but is retained fixed in axial translation, the retention of the casing in the axial direction can be ensured by shoulders of end parts of the diametrically widened parts 8, 9.

Figure 2:
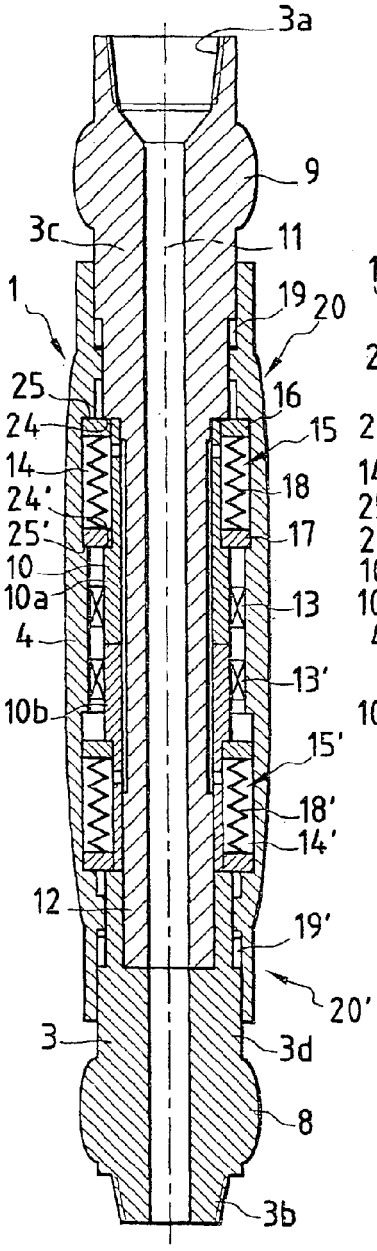
FIGS. 2, 3 and 4 are views in axial section of a stabiliser with an external casing which can be actuated according to the invention, in three different operating positions.
Figure 3:
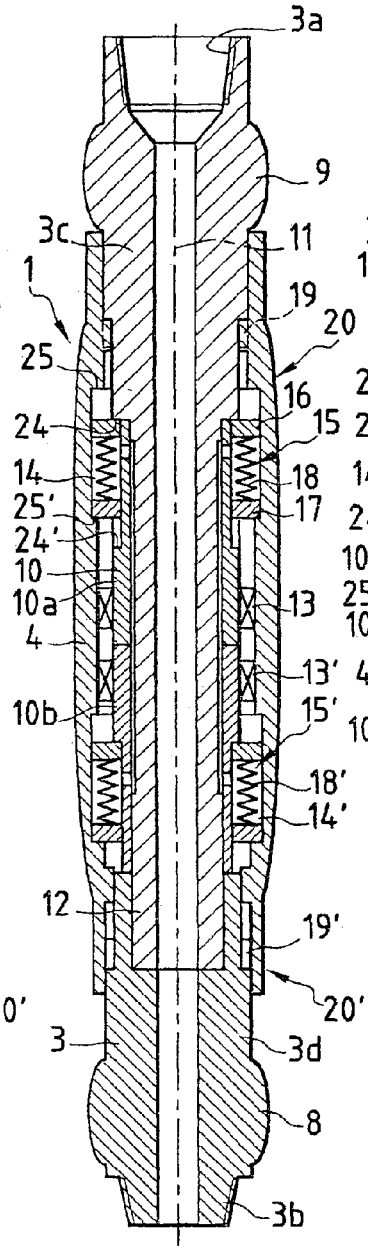
Figure 4:
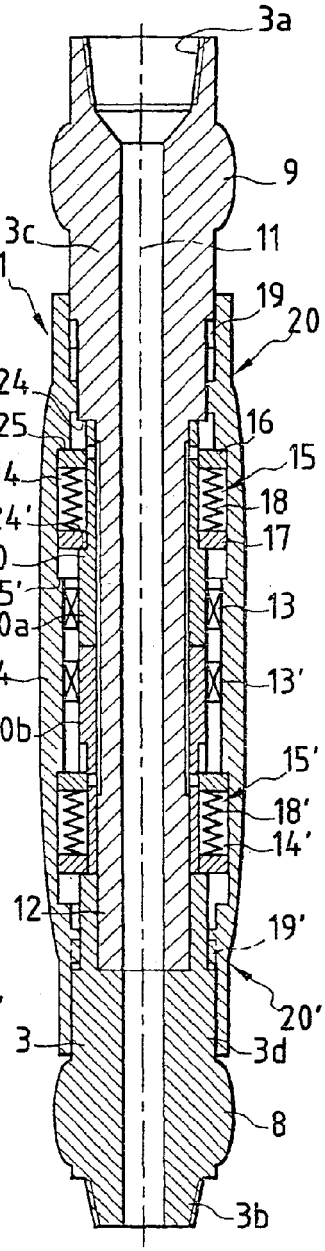

A stabiliser with an external casing 4 which is movable both in rotation and in axial translation, for example such as is shown in FIG. 1, is shown in FIGS. 2, 3 and 4 in axial section and in three different operating positions.

The corresponding elements in FIG. 1 on the one hand and in FIGS. 2, 3 and 4 on the other hand have the same reference numerals.

The central body 3 of the stabiliser 1 is produced in several parts in such a way as to ensure in particular the mounting of the central body 3 in the interior of the external casing 4.

The central body 3 of the stabiliser has an upper element 3*c* and a lower element 3*d* each produced in tubular form and assembled end to end, for example by screwing, in a coaxial position, with the interposition of a brace 10 constituting the third component element of the central body 3. The brace 10 of the central body 3 which is interposed between a shoulder of the upper element 3*c* and a shoulder of the lower element 3*d* of the central body is itself produced in two parts 10*a* and 10*b* which are placed one after the other in the direction of the axis 11 of the stabiliser.

The brace 10 interposed between the two parts 3*c* and 3*d* of the central body 3 of the stabiliser makes it possible in particular to increase the resistance to torsion or to compression of the connection 12 between the two parts 3*c* and 3*d* of the central body 3 which may be a simple screwed connection.

The brace 10 also has bearing elements 13 and 14' which ensure mounting of the external casing 4 of the stabiliser so as to rotate and to slide on the central body 3.

The two parts 10*a* and 10*b* of the casing 10 have at their respective upper and lower axial ends a part with reduced thickness placed so that in the mounting position of the stabiliser as shown in FIG. 2 they face a cavity or channel machined on the internal surface of the external casing 4.

Between the end parts of reduced thickness of the brace 10 and the channels or cavities of the external casing 4 compartments 14 and 14' are provided for the means for retaining and restoring the external casing 4, designated by the reference numerals 15 and 15'.

According to the invention, the resilient restoring elements 15 and 15' of the external casing in the axial direction bear, at each of their axial ends, both against a part of the central body 3 and against a part of the external casing 4 which are formed by shoulders situated in the radial planes perpendicular to the axis 11 of the stabiliser.

Each of the resilient restoring devices such as 15 and 15' disposed in an annular space 14 between the central body 3 and the external casing 4 of the stabiliser has an upper bearing ring 16 and a lower bearing ring 17 between which there is interposed at least one helical resilient restoring spring 18 which is deformable in compression in the axial direction 11.

Each of the upper and lower rings 16, 17 of a restoring device 15 bears against a radial shoulder 24 (or 24') of the central body 3 and a shoulder 25 (or 25') of the external casing 4 of the stabiliser 1. The shoulders such as 24 and 25 or 24' and 25' constitute with the bearing rings 16 and 17 abutments for precise relative positioning of the casing and of the central body.

The upper bearing ring 16 of the upper restoring device 15 bears against a shoulder 24 of the upper element 3*c* of the central body and against a shoulder 25 of the external casing 4.

The internal bearing ring 17 bears against not only against a shoulder 24' of the brace 10 of the central body of the stabiliser but also against an internal shoulder 25' of the external casing 4 of the stabiliser.

The lower restoring device 15' has upper and lower rings which respectively bear simultaneously against the brace 10 of the central body 3 and the external casing 4 of the stabiliser and against the lower element 3*d* of the external casing 4 of the stabiliser.

Furthermore, the springs such as 18 and 18' of the resilient restoring devices 15 and 15' are designed in such a way that, during mounting between the bearing edges of the central body 3 and the external contact casing 4, the bearing rings such as 16 and 17 ensure a pre-compression of the springs to a level which at the same time ensures a perfect stability of the external contact casing 4 of the stabiliser in its configuration as shown in FIG. 2, in which the casing can turn freely on the body 3, about the axis 11 of the stabiliser. The rings such as 16 and 17 bearing against the edges such as 24, 24', 25 and 25' with which they constitute abutments ensure perfect positioning of the external casing 4 with respect to the central body 3 in an axial position shown in FIG. 2. The edges such as 24 and 25 or 24' and 25' are retained by the resilient restoring devices in coincident axial positions.

During the drilling, the body 3 of the stabiliser which is fixed in rotation to the drill string can turn freely in the interior of the external casing 4 which comes into contact with the internal wall 2*a* of the borehole 2, which ensures its immobilisation in rotation relative to the wall 2*a* of the hole 2. As a result, during the drilling (or the extraction of the string of drill rods from the drilled hole) the external contact casing 4 of the stabiliser is immobilised in rotation against the wall of the borehole and is displaced in translation under the effect of the axial force exerted by the drill string.

The compression characteristics of the springs are such that the external casing 4 subjected to two axial thrust forces in two opposing directions parallel to the axis 11 of the stabiliser is perfectly stable in its precise position defined by the abutments and is not subject to any displacement nor vibration during the displacement of the drill string in translation in the interior of the borehole, as long as the borehole has a diameter close to a nominal diameter and a sufficiently smooth wall.

Therefore the stabiliser remains perfectly fixed in its configuration as shown in FIG. 2 in the normal conditions of drilling or of extraction of the drill string from the borehole. The stabiliser 1 then operates with a circumferential friction limited to the friction of the bearings of the stabiliser, that is to say with a low friction, and with a standard axial friction as a function of the general drilling characteristics.

The construction of the central body 3 of the stabiliser having two parts assembled end to end and a brace interposed between these two parts makes it possible to reserve a passage for liquid between the compartments 14 and 14' of the two bearing devices 15 and 15'. For this it is possible to provide a certain clearance between the brace and at least one of the two elements 3*c* and 3*d* of the central body (for example the upper element 3*c* as shown in FIG. 2) and openings passing through the brace 10 in the axial end parts of reduced thickness in such a way as to cause a passage in the axial direction provided between the brace and the element 3*c* to communicate with the compartments 14 and 14' of the resilient restoring devices.

Air or a lubricating liquid can then circulate between the compartments 14 and 14' of the resilient restoring devices.

The setting of the springs 18, 18' of the resilient restoring devices is such that the external contact casing 4 of the stabiliser bearing against the abutments remains perfectly immobile in the axial direction and perfectly stable with respect to the central body 3 of the stabiliser as long as the axial forces exerted between the external casing 4 and the central body 3 of the stabiliser under the effect of the axial forces exerted by the wall 2*a* of the borehole 2 do not exceed a certain limit corresponding to the setting of the springs 18 and 18'.

It should be noted that the stabiliser in its configuration as shown in FIG. 2 can remain perfectly stable within a very wide range of axial forces, due to the fact that it is possible to choose springs having adapted characteristics ranging up to very high characteristics and generating very high restoring forces. Thus it is possible to choose restoring devices with very high characteristics which make it possible to obtain good stability up to an extremely high level of forces.

It should be noted that the characteristics of the springs of the two devices 15 and 15' can be different. In all cases, the precise positioning of the casing is obtained by the abutments and the stability of retention is obtained due to the springs.

The stabiliser according to the invention has, in the vicinity of the axial ends of the external contact casing 4, means for coupling in rotation 20 and 20' of the external contact casing 4 and the central body 3. The means 20 and 20' each have a coupling ring 19 or 19' mounted so as to be movable in the axial direction in the interior of the central body 3 having teeth at its two axial ends for its engagement on corresponding teeth on a part projecting radially towards the interior of the external casing 4 and an internal part of the central body 3 of the stabiliser.

When the limiting value of the axial forces on the external contact casing 4 is exceeded, either when the drill string having the stabiliser 1 is lowered during the drilling, as shown in FIG. 3, or when the drill string having the stabiliser 1 is lifted for extraction of the drill string after the drilling, as shown in FIG. 4, the external contact casing 4 is displaced either upwards or downwards relative to the central body 3 of the stabiliser, which causes the displacement of the engaging ring 19 or 19' in the stabiliser body 3 and the meshing of the engaging ring 19 or 19' with the teeth of the central body 3 and of the external contact casing 4 of the stabiliser 1.

In the two cases shown in FIGS. 3 and 4 at the end of the displacement of the external casing 4 which has come into abutment against the central body 3 of the stabiliser, the external casing 4 and the central body of the stabiliser fixed to the drill string are fixed in rotation.

The rotation of the drill string ensures that the external casing 4 is set in rotation about the axis 11 of the stabiliser, and the external parts of the external casing such as blades effect a re-boring or a boring of the borehole in such a way that the axial friction of the stabiliser on the wall of the borehole returns to a sufficiently low level to permit the displacement of the drill string under a normal axial force.

As soon as the stabiliser 1 joined to the drill string has cleared the obstacle in the interior of the borehole (for example a narrowing of one of the projecting parts of the wall of the borehole), the casing 4 which is no longer subjected to a sufficient axial force to ensure additional compression of the springs 18 and 18' as shown in FIGS. 3 and 4 is restored to its position shown in FIG. 2.

It should be noted that the springs 18 and 18' which are in the compressed state for the stable retention of the external casing 4 of the stabiliser in its configuration as shown in FIG. 2 are both compressed simultaneously to a higher level which reaches its maximum when the external casing 4 comes into abutment against the body of the stabiliser with which it is then fixed in rotation.

In all the phases of use of the stabiliser as shown in FIGS. 2, 3 and 4, the external contact casing 4 is retained in a perfectly stable manner between the two compressed restoring devices 15 and 15', the compression of which increases with the displacement of the external casing 4.

Furthermore, the disengagement of the stabiliser in order to pass from the configuration shown in FIG. 2 to one of the configurations shown in FIGS. 3 and 4 is effected for a level of axial forces which is perfectly determined by the characteristics of the springs and the initial compression of these springs.

Figure 8:
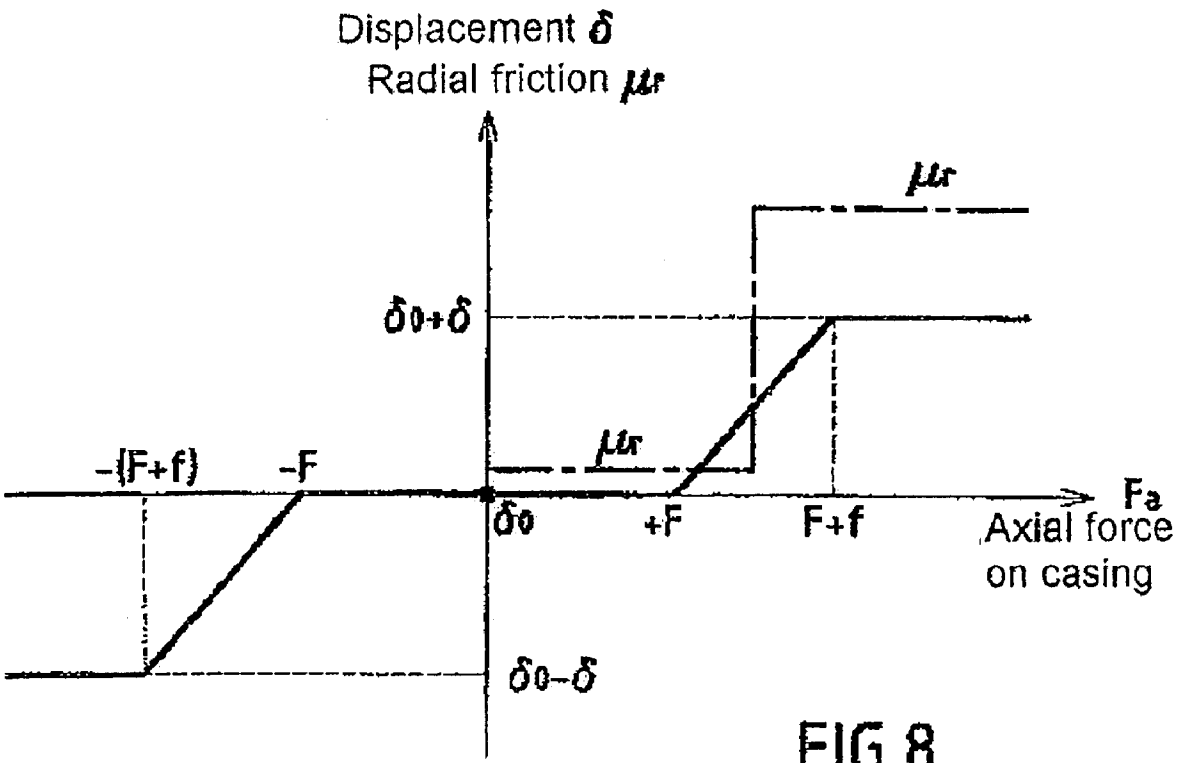
FIG. 8 is a diagram giving the relative displacement of the movable external casing of a stabiliser such as that shown in FIGS. 2, 3 and 4 as a function of the axial force on the external contact casing.
Figure 7:
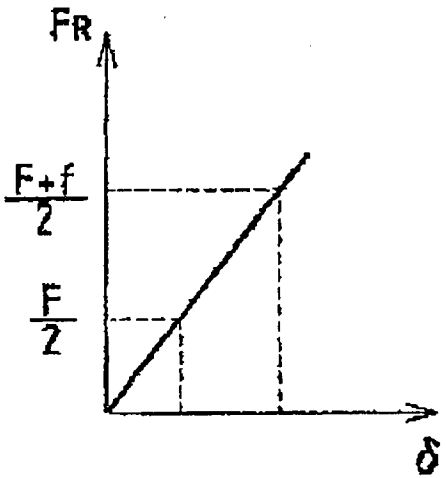
FIG. 7 is a diagram representing the compression of springs for retaining a stabiliser with an external casing for movable contact such as is shown in FIGS. 2, 3 and 4.

The operation of the stabiliser in its configuration shown in FIGS. 2, 3 and 4 and during passage between these configurations is shown in the form of diagrams in FIGS. 7 and 8.

The compression characteristics of the springs 18 and 18' which are assumed to be identical (they are not necessarily so) are shown in FIG. 7. As indicated above, the springs are pre-compressed upon mounting between the external contact casing 4 and the central body 3, the deformation being reflected by a pre-compression force F/2 for each of the springs.

Due to the mounting of the two resilient restoring devices interposed between the external casing and the central body of the stabiliser, the compression forces of the two restoring devices are additive, such that it is necessary to exert at least a force F in the axial direction between the external casing 4 and the central body 3 in order to obtain a displacement of the external casing 4 relative to the central body 3.

The choice of the characteristics of the springs as shown in FIG. 7 and of a level of pre-compression makes it possible to adjust the level of disengagement of the stabiliser at will between its non-rotary configuration shown in FIG. 2 and one of the rotary configurations shown in FIGS. 3 and 4.

As shown in FIG. 8, when the axial forces exerted on the external contact casing 4 increase from the disengagement value F up to a value F+f (in the direction of drilling) or from a value−F up to a value −(F+f) (in the direction of lifting), the casing 4 is displaced between its position shown in FIG. 2 and its position shown in FIG. 3 or FIG. 4, the casing then being in abutment against and fixed in rotation with the central body.

Starting from an initial position defined by the parameter $\delta_o$ in FIG. 8 obtained by the abutments and retained by the springs 18 and 18' of the restoring devices of which the restoring forces due to the pre-compression have additive effects, when the axial forces on the external casing in contact with the wall of the borehole remain within the range −F+F no displacement of the casing is produced relative to the central body of the stabiliser which is in a perfectly stable state shown in FIG. 2. The extent of the range −F+F can be adjusted to any value whatsoever which can be very high by choosing the characteristics of the springs and the pre-compression of these springs.

When during the progression of the drill string in the borehole a force value is reached which is higher in absolute value than F, either in the direction of lowering or in the direction of lifting of the drill string, the external contact casing starts to be displaced relative to the central body under an increasing force until the abutment of the external casing on the central body is achieved for a force value F+f or −(F+f). The casing is then displaced by the distance δ which is the freedom of movement of the casing relative to the central body. The external casing is set in rotation with the drill string when the teeth of the crown 19 come into engagement with the corresponding teeth of the central body 3 and of the external casing 4.

The radial friction $\mu_r$ of the stabiliser is also shown in FIG. 8. As long as the rotation of the external casing is not actuated, the radial or circumferential friction $\mu_r$ of the stabiliser is reduced to the internal friction of the bearing of the stabiliser and is therefore low. In contrast, the radial or circumferential friction $\mu_r$ reaches a high value as soon as the external casing of the stabiliser is set in rotation with the drill string and rubs against the wall of the borehole.

It should be noted that the setting in rotation of the external contact casing of the stabiliser can be progressive by the use of a clutch such as a disc clutch as described in U.S. Pat. No. 4,989,679, but preferably in the embodiment according to the invention a simple toothed coupling is used which permits the stabiliser to be made to operate with greater axial and rotational forces. In this case the setting in rotation of the external casing of the stabiliser (and correlatively the increase in the radial friction) is only obtained towards the end of the complete displacement of the external casing in translation by an extent δ.

According to an embodiment of the invention shown in FIGS. 1, 5A, 5B and 6 it is possible to obtain a stabiliser of which the friction in operation is greatly reduced by the effect of a liquid bearing and by entrainment of the debris of the drilling liquid in the direction of lifting, with an increased intensity.

Figure 5B:
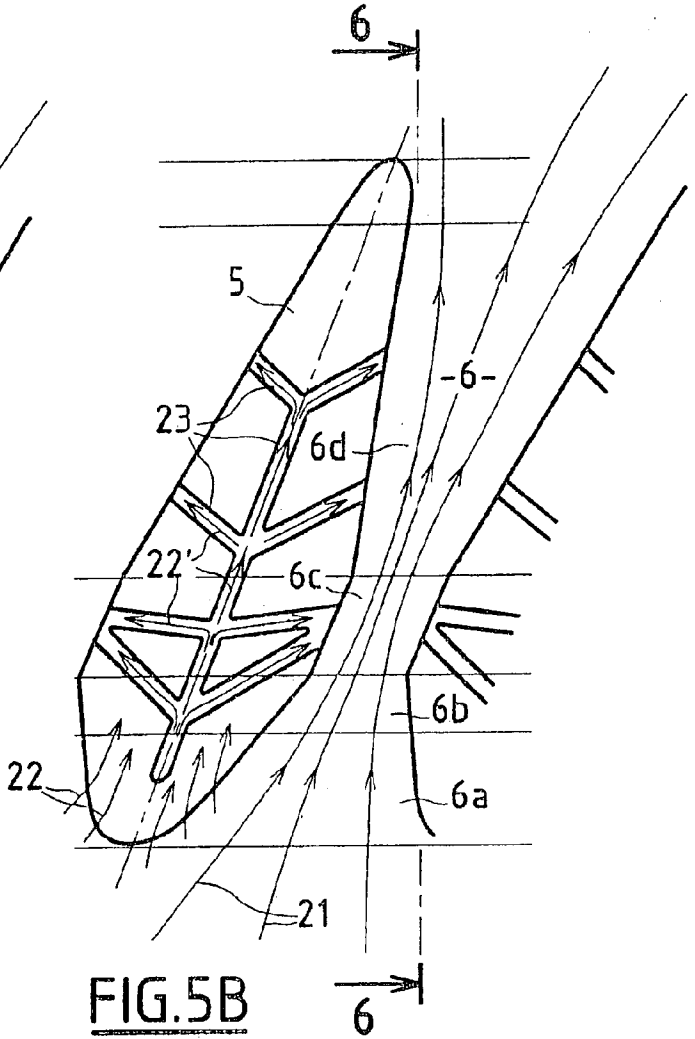
FIGS. 5A and 5B relate to two variants of the design of blades o the contact element of a stabiliser according to the invention in order to obtain an effect of a liquid bearing around the stabiliser.
Figure 5A:
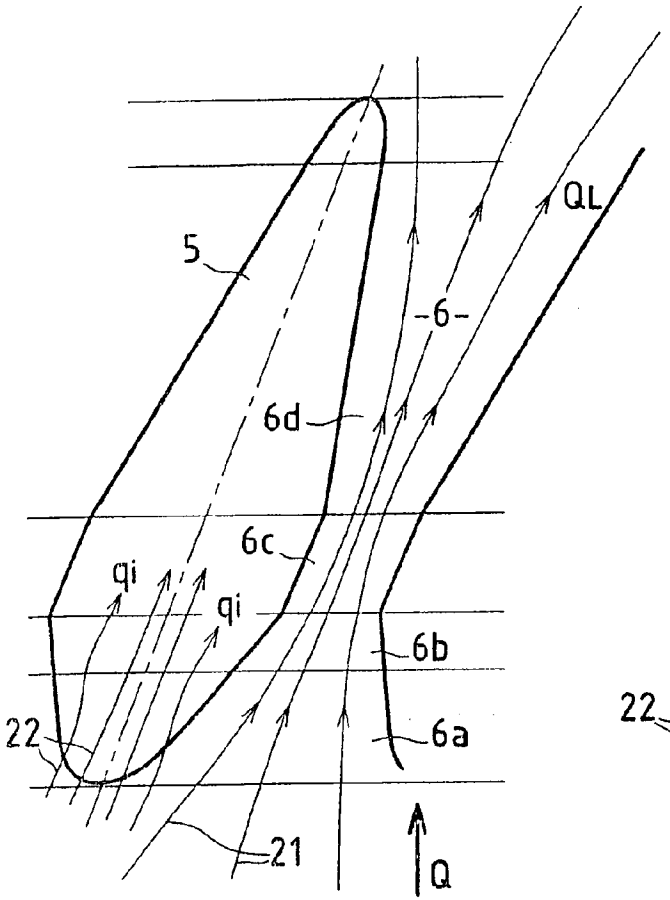

For this, as shown in particular in FIGS. 5A and B, the casing 4 has at least two blades 5 which have the general shape of a helix having as its axis the axis 11 of the stabiliser and are machined so as to project radially on the external surface of the external contact casing 4 of the stabiliser and the inter-blade space 6 between two successive blades 5 is produced in such a way as to divert part of the flow of drilling liquid on contact with the stabiliser in order to obtain an effect of a liquid bearing. Furthermore, as shown in FIG. 6 the profile of the inter-blade spaces 6 in the radial direction is also adapted to improve the effect of a liquid bearing and the entrainment of the debris contained in the drilling liquid and circulating from bottom to top in the vertical direction as indicated by the arrow 7.

Figure 6:
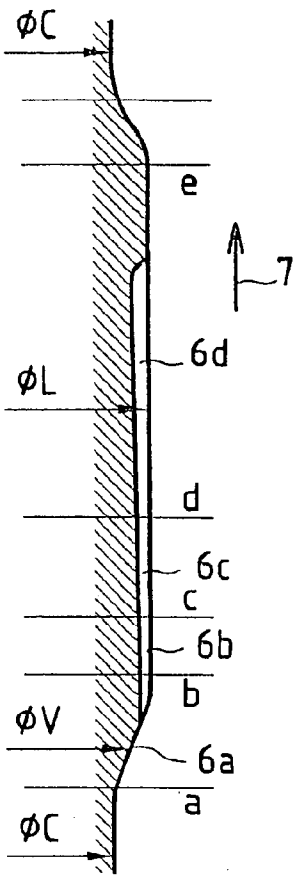
FIG. 6 is a view in axial section of an inter-blade space along the line 6—6 in FIG. 5A or FIG. 5B.

As can be seen in FIGS. 5A and 5B, the inter-blade passages 6 have, in the direction 7 of circulation of the drilling liquid, an inlet part 6*a* in which the inter-blade space has a decreasing width in the circumferential direction of the casing of the stabiliser, from a high value corresponding to a wide inlet opening for liquid in the inter-blade space to a substantially lower value, the radial profile, as shown in FIG. 6, of the zone 6*a* of the inter-blade space (between the points a and b) being such that the diameter $\Phi_V$ of the stabiliser passes from a value $\Phi_C$ to a value $\Phi_L$ (with $\Phi_C<\Phi_L$).

In the following zone 6*b* of the inter-blade space 6, the width of the inter-blade space in the circumferential direction decreases to a minimum value, the radial profile of the casing of the stabiliser in this zone being shown by the part b c of the contour shown in FIG. 6. In the zone 6*b*, the diameter of the casing of the stabiliser remains constant and equal to $\Phi_L$.

In a following zone 6*c* of the inter-blade space 6, the width of the inter-blade space is substantially constant and the radial profile represented by the segment c d in FIG. 6 corresponds to a constant diameter of the external casing $\Phi_L$.

Finally, in the zone 6*d* of the inter-blade space 6, the width of the inter-blade space in the circumferential direction increases from the minimum value to a maximum value at the outlet of the inter-blade space, when the circulation of the liquid in the direction of the arrow 7 is considered.

The diameter of the stabiliser equal to $\Phi_L$ in the part d e returns to the nominal value $\Phi_C$ in the outlet part of the inter-blade space 6.

As shown by the arrows 21 and 22 in FIGS. 5A and 5B, the total flow of drilling liquid Q circulating in contact with the stabiliser at the level of the blades 5 and of the inter-blade space 6 is divided between a flow $\Phi_L$ circulating in the interior of the inter-blade space 6 and a flow $\Sigma q_i$ for flushing the blades 5.

The flow $Q_L$ circulating between the blades in the inter-blade space 6 is subjected to a Venturi effect in the zone 6*c* of reduced diameter, the pressure of the liquid being minimal in this zone and the speed increasing.

An additional acceleration of the liquid circulating in the inter-blade space 6 is obtained in the outlet part 6*d*.

Part of the circulation of the liquid is diverted in the zone of the blades 5, as shown by the arrows 22 representing the flows $q_i$ which propagate on contact with the blades 5 in order to ensure an effect of a liquid bearing by spreading a layer of liquid taken from the principal flow at the inlet of the inter-blade space 6.

The radial profile shown in FIG. 6 makes it possible to favour the effect of a liquid bearing and moreover to activate the entrainment of the debris contained in the drilling liquid, in particular in the output zone 6*d* in which the drilling liquid circulates at very high speed.

In the case of a blade of which the external surface as shown in FIG. 5A does not have any channels for circulation of drilling liquid, the flows $q_i$ are spread over the blade in such a way as to form a layer of liquid which ensures the effect of a bearing around the stabiliser.

The effect of a liquid bearing can be improved by the provision of channels for the passage of liquid which are machined into the surface of the blades 5. The channels 23 have a longitudinal connection part according to the longitudinal direction of the strip and lateral parts which open into the inter-blade spaces on each side of the corresponding blade 5.

Low liquid pressures at the level of the zone 6*c* forming the throat of the Venturi and in the outlet part 6*d* of the inter-blade space make it possible to favour the circulation of liquid in the channels 23, as shown by the arrows 22'.

Due to the production of the inter-blade spaces 6 with a Venturi throat, the pressure of the drilling liquid in the zones 6*a* and 6*b* is higher than the pressure of drilling liquid in the zone 6*c* and the pressure of drilling liquid in the zone 6*d*, which is higher than the pressure of liquid in the zone 6*c*, is lower than the pressure of liquid in the zone 6*a*.

The Venturi effect also makes it possible to accelerate the solid particles of debris in the drilling liquid circulating from bottom to top in the annular space of the borehole. This favours the elimination of the debris and the entrainment thereof with the drilling liquid circulating from bottom to top.

An effective flushing and excellent cleaning of the zones of contact of the wall of the hole with the blades of the stabiliser is also carried out, which makes possible a substantial reduction in the coefficients of friction in the axial and circumferential directions.

In all the cases, the shape of the inter-blade spaces in the axial direction and the longitudinal profile of the external surface of the casing of the stabiliser combine in order to reduce the radial friction and the axial friction of the stabiliser.

Machining of the external contact part of the stabiliser in order to produce the blades and the inter-blade spaces as shown in FIGS. 5A, 5B and 6 may make possible a considerable reduction in the friction during all of the operating phases of the stabiliser, not only in the case of a stabiliser produced in one piece and constantly turning with the string of drill rods but also in the case of a stabiliser have a casing mounted so as to rotate relative to the central body of the stabiliser. In particular, blades and inter-blade spaces and a profile of the external surface of the casing as described may be used advantageously in the case of a casing which is mounted so as to rotate on the central body of the stabiliser and can be non-rotating or, on the contrary, rotating with the drill string after actuation of coupling in rotation of the external casing with the central body of the stabiliser.

In all the cases, the stabiliser according to the invention has improved operating conditions in so far as the friction of its external part on the wall of the borehole is concerned.

The invention is not limited to the embodiments which have been described.

The stabiliser may have an external casing in one piece with the central body of the stabiliser or, on the contrary, a casing mounted so as to rotate and slide and capable of being engaged in a coupling position in rotation with the central body of the stabiliser and the string of drill rods.

In the case of an external casing mounted so as to rotate and slide on the central body of the stabiliser, the retention of the external casing in a non-engaged position is achieved in a very stable manner according to the invention. In this case the blade and inter-blade spaces of the stabiliser may or may not have a shape which favours a hydraulic effect of a liquid bearing around the stabiliser.

The invention applies to any stabiliser of a rotary string of drill rods.

What is claimed is:

1. Stabiliser device for a string of drill rods which can rotate about a longitudinal axis of the drill string and is subjected to a force in the axial direction ensuring the centering and guiding of the drill string in a borehole and has a tubular central body having means for connection to a first and a second component of the string of drill rods at a first and a second axial end and at least one external element for contact of the stabiliser with a wall of the borehole, wherein the external element for contact of the stabiliser with the wall of the borehole has at least one means for activating a means which co-operates with the wall of the borehole in order to limit the friction between the external contact element of the stabiliser and the wall of the borehole, and that it is mounted on the central body in an axial position which remains fixed at least within a range of values of an axial force exerted between the central body and the external contact element, the extent of which can be fixed at any value whatsoever, and wherein the external contact element of the stabiliser is a tubular casing mounted so as to slide in the direction of the axis and to rotate about the axis of the stabiliser on the central body, that the means co-operating with the wall of the borehole is at least one blade integral with the external surface of the external element, and that the means for activation of the means co-operating with the wall of the borehole consists of at least one means for mechanical coupling in rotation between the external casing and the central body of the drill rod, when the external casing is displaced axially relative to the body in the direction of the axis under the effect of forces exerted between the blade of the casing and the wall of the borehole, the casing being retained in a position in which it is freely rotatable on the body about the axis by resilient means for restoring in the direction of the axis which bear by two axial ends on edges perpendicular to the axis both of the central body and of the external casing of the stabiliser and constitute abutments for precise positioning of the external casing relative to the central body of the stabiliser in such a way that resilient restoring means are both compressed simultaneously by displacement of the external casing towards a position of coupling to at least one means for mechanical coupling in rotation.

2. Device as claimed in claim 1, characterised in that it comprises two devices for restoring in the direction of the axis which are spaced from one another in the direction of the axis and mounted between the central body and the external casing of the stabiliser in such a way as to be pre-compressed when the external casing is in a position where it is freely rotatable about the axis of the stabiliser and both compressed simultaneously when the casing is displaced towards a position of coupling to a device for coupling in rotation with the central body.

3. Device as claimed in claim 1, characterised in that it comprises a first and a second means for mechanical coupling of the external casing in rotation with the central body of the stabiliser in such a way that during the displacement in the direction of the axis of the external casing under the effect of the axial drilling force exceeding a limiting value, the external casing is coupled by a first end to the first means for coupling to the central body, and that for displacement in an opposite direction in the direction of the axis under the effect of an axial force when the drill rod is being lifted from the borehole exceeding a predetermined limit, the external casing is coupled to the central body by a second end with the second device for mechanical coupling to the central body.

4. Device as claimed in claim 1, characterised in that the at least one restoring device has at least one helical spring having an axis of compression in the direction of the axis, a first axial end bearing on a ring and a second axial end bearing on a second bearing ring, the bearing rings ensuring bearing of the resilient restoring device at its two axial ends both on a bearing edge of the central body and a bearing edge of the external casing, the bearing rings and the bearing edges constituting abutments for axial positioning of the external casing.

5. Device as claimed in claim 1, characterised in that each of the means for mechanical coupling in rotation of the central body and the external casing of the stabiliser has a ring having a first set of teeth for engagement with a corresponding set of teeth on the central body and second set of teeth for engagement with a set of teeth on the external casing.

6. Stabiliser as claimed in claim 1, characterised in that the central body of the stabiliser has a first element and a second element having means for fixing one to the other end to end in the direction of the axis of the stabiliser and a brace in two parts which are placed end to end in the direction of the axis of the stabiliser and interposed between a first shoulder of the first element of the central body and a second shoulder of the second element of the central body.

7. Device as claimed in claim 6, characterised in that the external casing is mounted so as to rotate about the axis and to slide in the direction of the axis on the body of the stabiliser by means of at least one bearing interposed between the brace of the central body and the external casing of the stabiliser.

8. Device as claimed in claim 1, characterised in that the external contact element of the stabiliser is rigidly joined to the central body and in particular is produced in one piece with the central body.

9. Device as claimed in claim 1, characterised in that the external contact element has a tubular casing mounted so as to rotate on the central body about the axis of the drill string and of the stabiliser and immobilised in axial translation on the central body.

10. Device as claimed in claim 1, characterised in that it has on at least one side of the external contact element in the direction of the axis of the stabiliser a diametrically widened part of the central body with respect to a nominal diameter of the central body and of the string of drill rods.

11. Device as claimed in claim 10, characterised in that the parts of the central body which have a widened diameter are of substantially spherical shape and have grooves of helical shape.

12. Stabiliser device for a string of drill rods which can rotate about a longitudinal axis of the drill string and is subjected to a force in the axial direction ensuring the centering and guiding of the drill string in a borehole and has a tubular central body having means for connection to a first and a second component of the string of drill rods at a first and a second axial end and at least one external element for contact of the stabiliser with a wall of the borehole, wherein the external element for contact of the stabiliser with the wall of the borehole has at least one means for activating a means which co-operates with the wall of the borehole in order to limit the friction between the external contact element of the stabiliser and the wall of the borehole, and that it is mounted on the central body in an axial position which remains fixed at least within a range of values of an axial force exerted between the central body and the external contact element, the extent of which can be fixed at any value whatsoever, and wherein the contact element of the stabiliser has at least two blades projecting radially on its external surface in a helical arrangement about the axis of the stabiliser between which an inter-blade space is provided, the width of which in a circumferential direction of the stabiliser varies in the axial direction of the stabiliser in such a way as to constitute the means for activation of the means co-operating with the wall of the borehole in order to limit the friction of the stabiliser consisting of a drilling liquid circulating in the direction of the axis of the stabiliser in an annular space between the wall of the borehole and the external surface of the stabiliser, the inter-blade space having the shape of a Venturi in the direction of the axis and of the circulation of the drilling liquid in such a way as to create an effect of a liquid bearing following the blades of the contact element of the stabiliser.

13. Device as claimed in claim 12, characterised in that the inter-blade space has in the circumferential direction a variable width along the direction of the axis of the stabiliser and the direction of circulation of the drilling liquid, a first part of the inter-blade space having a circumferential width decreasing in the direction of circulation of the drilling liquid, a second part following the part in the direction of circulation of the drilling liquid having a width which is substantially constant and reduced in order to constitute a throat of the Venturi, and a third part of the inter-blade space having an increasing width for the acceleration of the drilling liquid circulating in the annular space in the borehole and the external contact element of the stabiliser having a diameter increasing in a first section in the direction of circulation of the drilling liquid of the first part of the inter-blade space up to a maximum value.

14. Device as claimed in claim 12, characterised in that the at least two blades of the external contact element of the stabiliser have an external contact surface without channels for the circulation of drilling liquid.

15. Device as claimed in claim 12, characterised in that the at least two blades of the external contact element of the stabiliser are machined in order to have channels along the length of the blades and in lateral arrangements for the circulation of the drilling liquid producing an effect of a liquid bearing along the blade.

16. Device as claimed in claim 12, characterised in that the external contact element of the stabiliser is rigidly joined to the central body and in particular is produced in one piece with the central body.

17. Device as claimed in claim 12, characterised in that the external contact element has a tubular casing mounted so as to rotate on the central body about the axis of the drill string and of the stabiliser and immobilised in axial translation on the central body.

18. Device as claimed in claim 12, characterised in that it has on at least one side of the external contact element in the direction of the axis of the stabiliser a diametrically widened part of the central body with respect to a nominal diameter of the central body and of the string of drill rods.

19. Device as claimed in claim 18, characterised in that the parts of the central body which have a widened diameter are of substantially spherical shape and have grooves of helical shape.

* * * * *